US007134886B2

(12) United States Patent
Okamura et al.

(10) Patent No.: US 7,134,886 B2
(45) Date of Patent: Nov. 14, 2006

(54) CONNECTOR AND TERMINAL FITTING

(75) Inventors: Kenji Okamura, Yokkaichi (JP); Tetsuya Aihara, Yokkaichi (JP); Hiroshi Nakano, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/237,124

(22) Filed: Sep. 28, 2005

(65) Prior Publication Data

US 2006/0068620 A1 Mar. 30, 2006

(30) Foreign Application Priority Data

Sep. 29, 2004 (JP) ..... 2004-313084
Sep. 29, 2004 (JP) ..... 2004-313085

(51) Int. Cl.
*H01R 12/00* (2006.01)

(52) U.S. Cl. ..... 439/79

(58) Field of Classification Search ..... 439/79
See application file for complete search history.

(56) References Cited

U.S. PATENT DOCUMENTS 5,186,633 A * 2/1993 Mosser, III ..... 439/79
5,201,662 A * 4/1993 Roche ..... 439/79
5,277,596 A 1/1994 Dixon
5,281,152 A * 1/1994 Takahashi et al. ..... 439/79
5,547,384 A * 8/1996 Benjamin ..... 439/79
6,341,964 B1 * 1/2002 Yu ..... 439/79
6,461,173 B1 * 10/2002 Mizuno et al. ..... 439/79
6,506,063 B1 1/2003 Moriwake et al.
6,575,773 B1 6/2003 Takeuchi
6,733,307 B1 * 5/2004 Wu ..... 439/79
6,736,650 B1 * 5/2004 Chen et al. ..... 439/79
6,811,433 B1 * 11/2004 Jou ..... 439/541.5
6,926,542 B1 * 8/2005 Li ..... 439/79
2001/0006854 A1 * 7/2001 Moriwake et al. ..... 439/78
2004/0115969 A1 * 6/2004 Jou ..... 439/79
2005/0026474 A1 * 2/2005 Li ..... 439/79

FOREIGN PATENT DOCUMENTS

JP 6-203928 7/1994

* cited by examiner

*Primary Examiner*—Ross Gushi
(74) *Attorney, Agent, or Firm*—Gerald E. Hespos; Anthony J. Casella

(57) ABSTRACT

L-shaped terminal fittings (11A, 11B) have terminal connecting portions (12) at one end. The terminal connecting portions (12) are pressed into upper and lower stages of a housing (20) for connection with a mating terminal. Narrower board connecting portions (13) are at the opposite ends of the terminal fittings (11A, 11B) and have mounting portions (16) to be soldered to a PCB (40). The terminal connecting portions (12) of the upper stage align respectively with the terminal connecting portions (12) of the lower stage. However, the board connecting portions (13) in the upper and lower stages are offset laterally with respect to longitudinal axes (X) of the terminal connecting portions (12). Additionally, all of the board connecting portions (13) of the terminal fittings (11A, 11B) are arrayed in one row equally spaced from the housing (20).

5 Claims, 12 Drawing Sheets

CONNECTOR AND TERMINAL FITTING

BACKGROUND OF THE INVENTION

1. Field of the Invention

The invention relates to a connector for an electric or electronic device such as a circuit board, and to a terminal fitting therefor.

2. Description of the Related Art

Japanese Unexamined Patent Publication No. H06-203928 discloses a connector mountable on a printed circuit board. This connector has small and large terminal fittings bent in L-shape. The connector also has a housing with press-in holes arranged side by side at even intervals along a width direction at upper and lower stages. The upper press-in holes are aligned vertically with the lower press-in holes. One end of each small terminal fitting is inserted into the press-in hole at the lower stage to project forward. The other end of each small terminal fitting projects back from the housing and then is bent down. One end of each large terminal fitting is pressed into the press-in hole at the upper stage to project forward by the same distance as the corresponding side of the small terminal fitting. The other end of the large terminal fitting projects back from the housing by a longer distance than the corresponding end of the small terminal fitting and is then bent down. The rear ends of the large and small terminal fittings are fixed to conductor regions on the circuit board. This circuit board connector has an advantage of mounting the terminal fittings at a high density along the width direction of the housing, and thus achieves miniaturization of the housing along the width direction.

The rear ends of the terminal fittings at the upper and lower stages of the above-described connector are arrayed one after another along the depth direction at the rear end of the housing. Thus, a dimension of the entire connector along the depth direction tends to be large.

Another known a connector has press-in holes at an upper stage offset from the press-in holes at the lower stages by half the interval between the press-in holes. In this example, rear ends of terminal fittings at the upper and lower stages can be arrayed side by side at the same distance rearward of the housing. Thus, the connector can be made smaller along depth direction. However, this known connector is enlarged along width direction. Thus, there has been an earnest demand for improvements.

The present invention was developed in view of the above problems and an object thereof is to miniaturize a connector.

SUMMARY OF THE INVENTION

The invention relates to a connector for an electric or electronic device, such as a circuit board. The connector has a housing to be mounted on an electric or electronic device. Terminal fittings are mounted substantially side by side along width direction at each of a plurality of stages in the housing. Each terminal fitting has opposite front and rear ends. A terminal connecting portion is formed at the front end of each terminal fitting and projects forward of the housing for connection with a mating terminal. A device connecting portion is formed at the rear end of each terminal fitting and projects back from the housing. The device connecting portion is bent toward the electric or electronic device for connection with the electric or electronic device. The device connecting portions are narrower than the terminal connecting portions.

The terminal connecting portions of at least certain of the terminal fittings are aligned along the height direction through the respective stages. However, the device connecting portions of these terminal fittings are arranged in different areas defined by dividing the terminal fittings along width direction by the same number as the number of the stages. Thus, the device connecting portions are arrayed transversely in one row at positions spaced back by the same distance from the housing. Accordingly, the width of the housing can be shortened and, simultaneously, the backward projecting distance of the terminal fittings from the housing can be shortened. Therefore, a mounting space is smaller and the material cost and the production cost of the housing are reduced.

Two terminal fittings have their terminal connecting portions substantially vertically aligned, but have their board connecting portions offset to substantially opposite widthwise sides with respect to longitudinal axes of the terminal connecting portions. However, these laterally offset device connecting portions of the two stages are arrayed transversely in one row at positions distanced back by substantially the same distance from the housing.

The terminal fittings are mounted by pressing the terminal connecting portions into press-in holes in the housing. Steps preferably are defined between the terminal connecting portions and the device connecting portions for pressing the terminal connecting portions into the press-in holes. The steps preferably are substantially normal to the longitudinal axes of the terminal connecting portions.

The device connecting portion preferably is fixable to the electric or electronic device by the reflow soldering. Reflow soldering means that solder is applied to the circuit board beforehand and the mounting portions of the terminal fittings are placed on the solder. The solder then is melted in a high-temperature environment to connect the mounting portions with the circuit board. In other words, reflow soldering is a process that enables the soldering of components through a gradual and controlled heating of the components in a heated environment (such as in a furnace, typically a belt furnace). In particular, a paste formed of solder powder and flux suspended in an organic vehicle is melted by the application of heat so that the components are joined through the mass heating of the preplaced solder paste to solder fillets in the metallized surfaces thereof.

Bent portions at the rear ends of the terminal fittings preferably are wider and/or thicker than the device connecting portions to increase bending rigidity. The board connecting portions can be bent with high precision by increasing the bending rigidity of the bent portions of the terminal fittings, and the mounting portions at the ends thereof can be arranged in proper postures to face the circuit board. Thus, the lower surfaces of the mounting portions can be pressed against the solder applied to the circuit board in wide areas, and the mounting portions can be fixed securely and strongly. Precise reflow soldering can be expected due to the precise bending of the terminal fittings.

As noted above, the width of the housing can be shortened and, simultaneously, the backward projecting distance of the terminal fittings from the housing can be shortened. These desirable results are achieved partly because the board connecting portions are narrower than the terminal connecting portions. Additionally, the bent portions are widened to increase bending rigidity so that the narrower board connecting portions can be bent with high precision and the mounting portions at the leading ends of the board connecting portions can be arranged in proper postures to face the circuit board. As a result, precise reflow soldering can be achieved.

The housing preferably is mounted while being slightly lifted from the electric or electronic device and/or a recessed surface is formed in at least part of a surface of the housing substantially facing an arranging surface of the device to provide a flux escaping space between the recessed surface and the arranging surface of the device.

The invention also relates to the above-described bent terminal fitting.

DETAILED DESCRIPTION OF THE PREFERRED EMBODIMENTS

Figure 1:
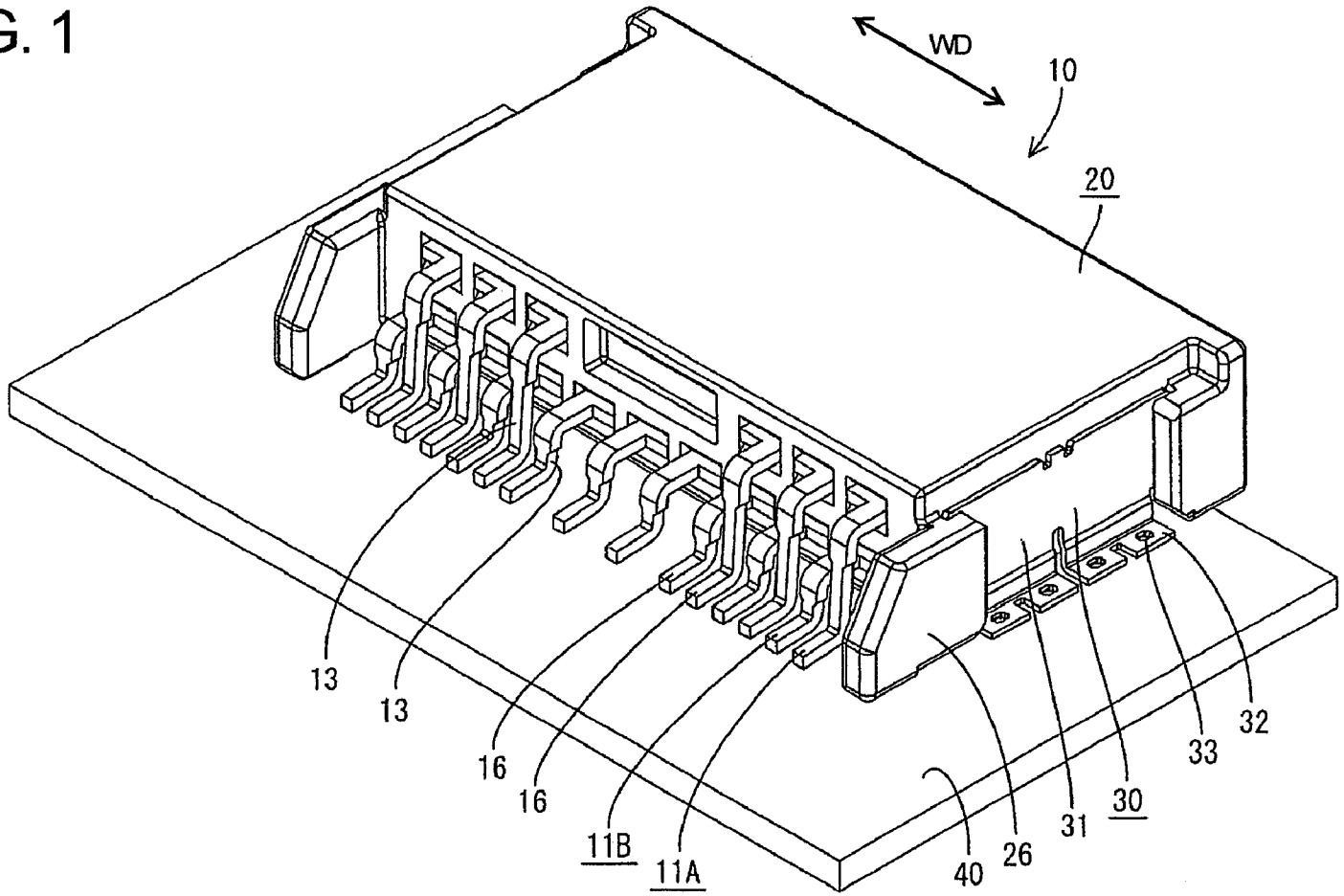
FIG. 1 is a perspective view showing a state where a connector according to a first embodiment of the invention is mounted on a PCB.
Figure 2:
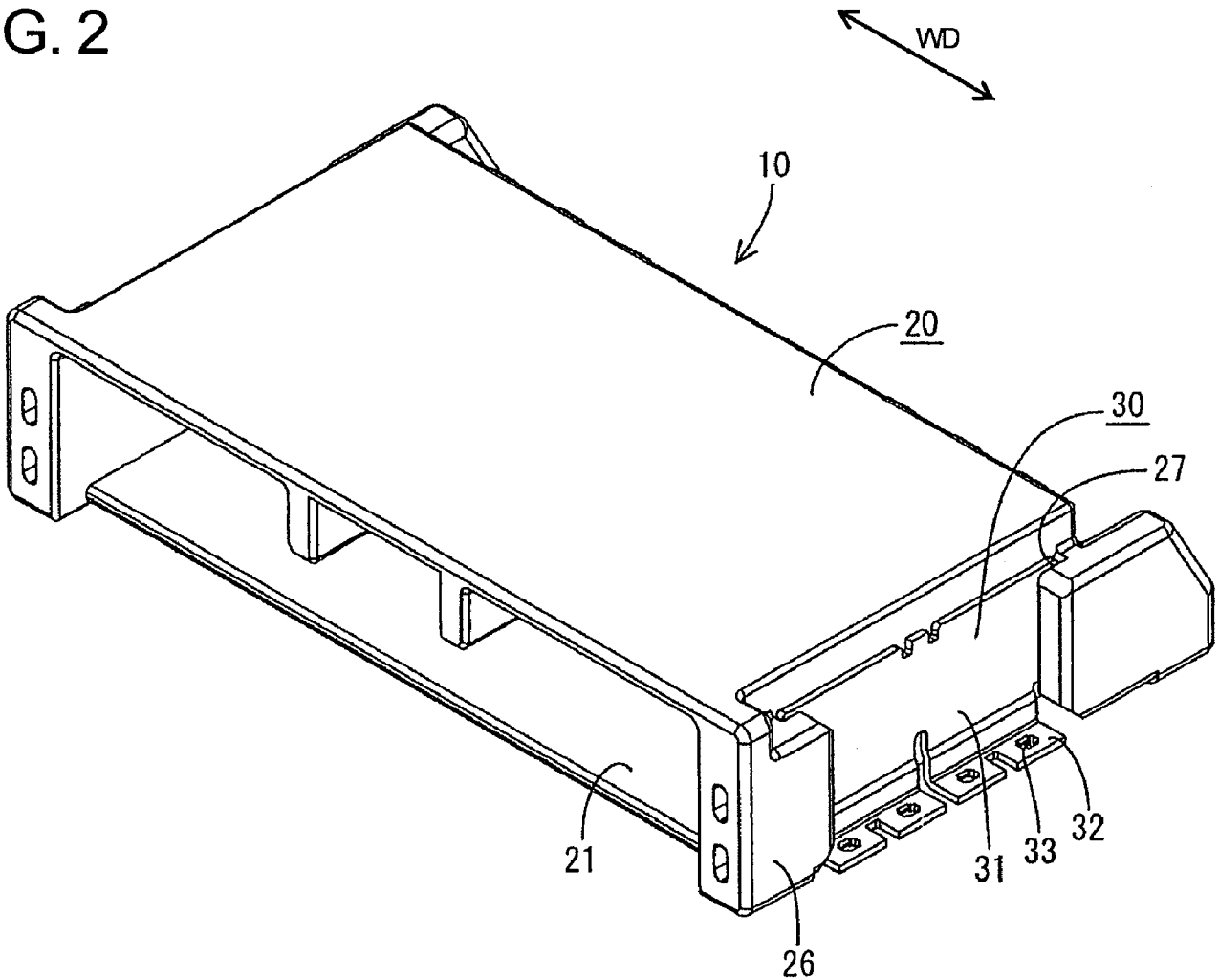
FIG. 2 is a rear perspective view of the connector.

A first embodiment of the invention is described with reference to FIGS. 1 to 10. As shown in FIG. 1, terminal fittings 11 are mounted in a housing 20 of a circuit board connector 10. A mating side of the connector 10 to be connected with an unillustrated mating connector is referred to as the front. The housing 20 is to be placed on a printed circuit board 40 (hereinafter PCB 40) and the respective terminal fittings 11 are to be connected with the PCB 40 preferably by reflow soldering. Fixing members 30 are to be mounted on the opposite side surfaces of the housing 20 and similarly fixed to the PCB 40, preferably by reflow soldering.

Figure 3:
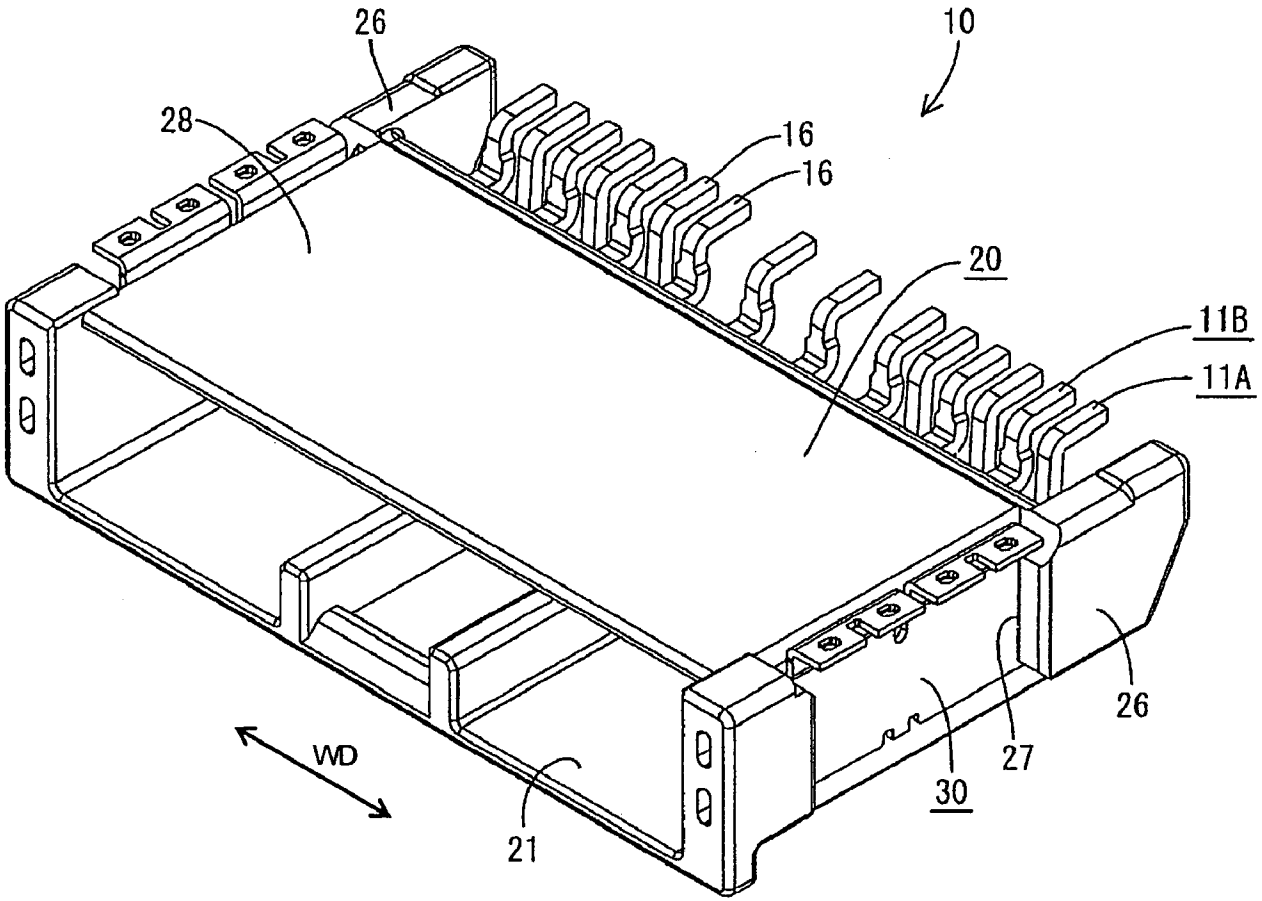
FIG. 3 is a perspective view of the connector viewed from below.
Figure 4:
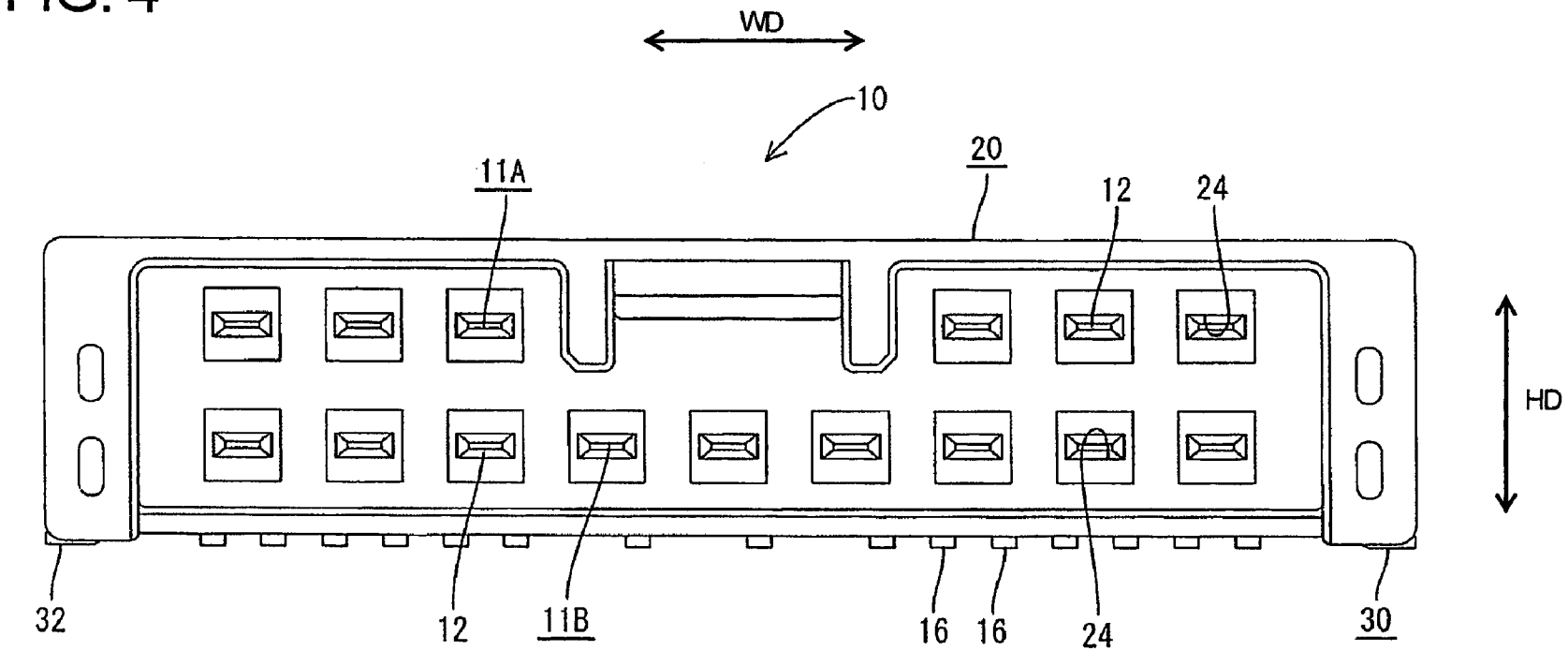
FIG. 4 is a front view of the connector.
Figure 5:
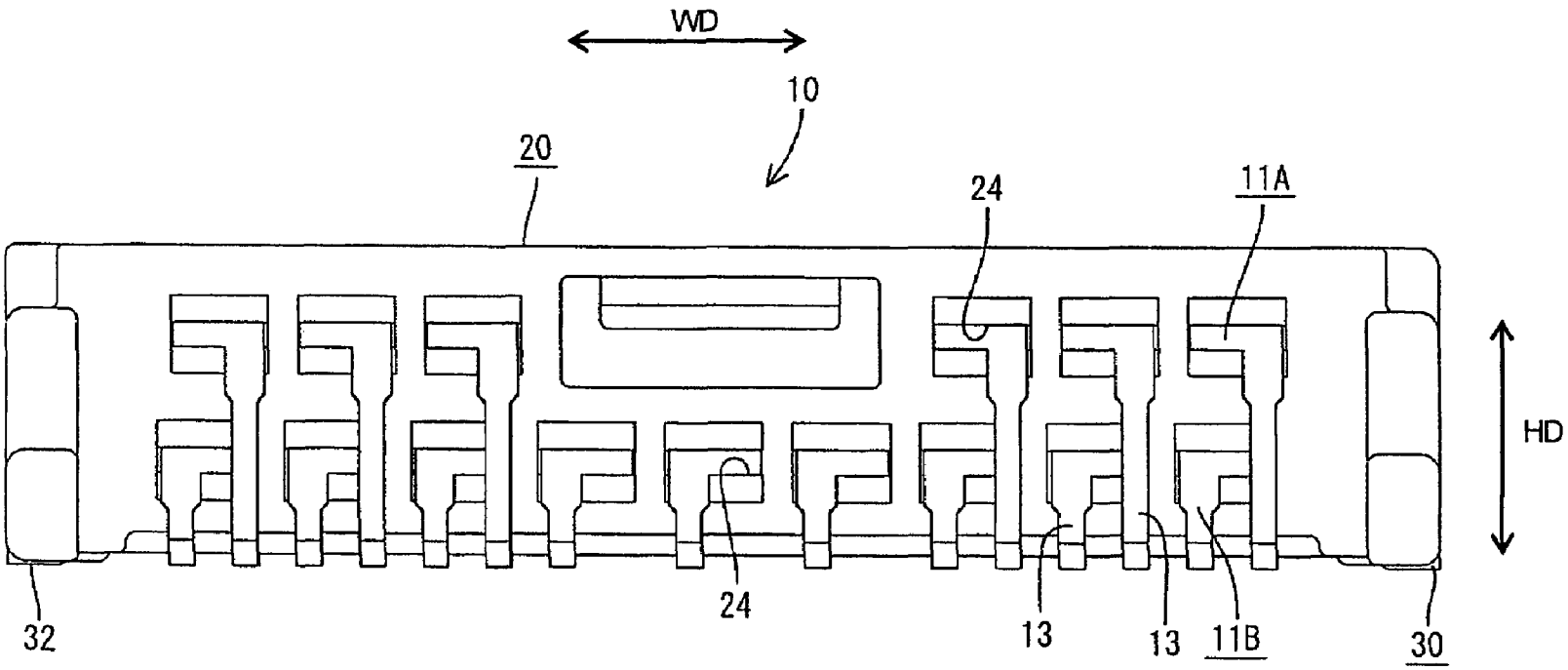
FIG. 5 is a rear view of the connector.

As shown in FIGS. 2 to 6, the housing 20 is a wide block-shaped structure made e.g. of a synthetic resin and having opposite front and rear ends. A fitting recess 21 is formed in the front end of the housing 20 and is configured for receiving a mating female housing (not shown). The housing 20 has a base wall 22 at the rear end of the fitting recess 21 and press-in holes 24 extend through the base wall 22. The press-in holes are formed substantially side by side substantially along a width direction WD at upper and lower stages in the base wall 22. As shown in FIG. 4, three press-in holes are formed at substantially even intervals at each of the opposite widthwise sides of the upper stage, whereas nine press-in holes 24 are formed at substantially the same intervals over substantially the entire width at the lower stage. The three press-in holes 24 at each side of the upper stage are aligned vertically straight with the corresponding press-in holes 24 of the lower stage.

Figure 7A:
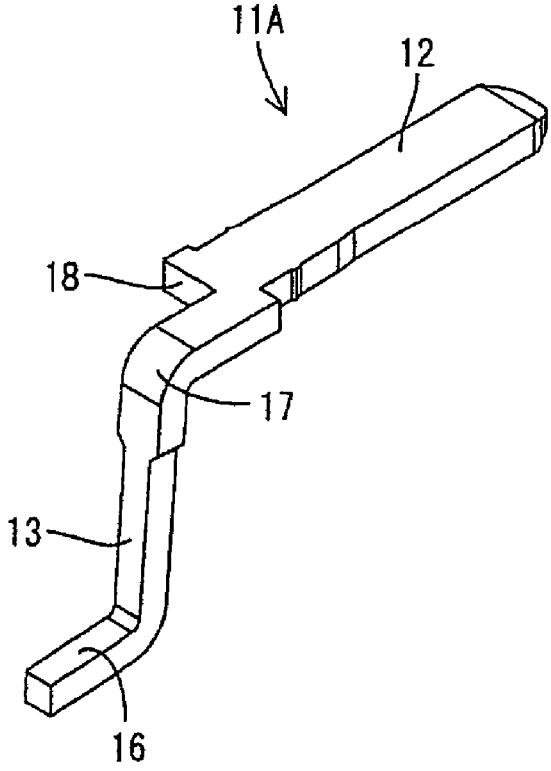
FIGS. 7(A) and 7(B) are perspective views of first and second terminal fittings.
Figure 7B:
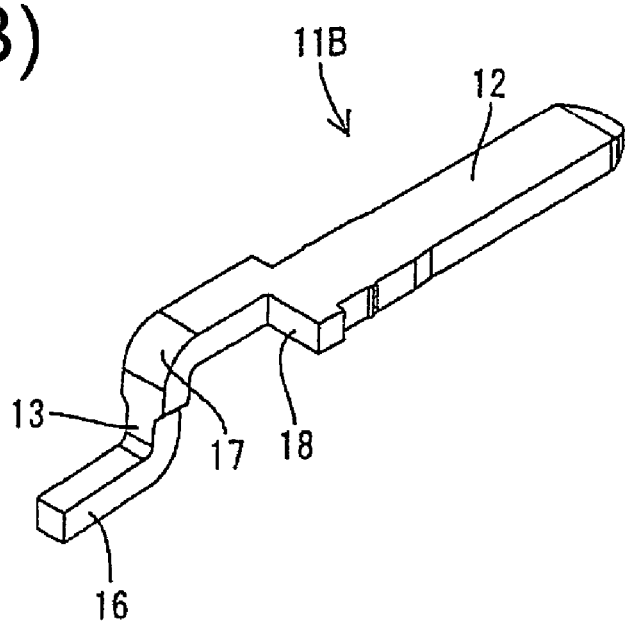
Figure 8A:
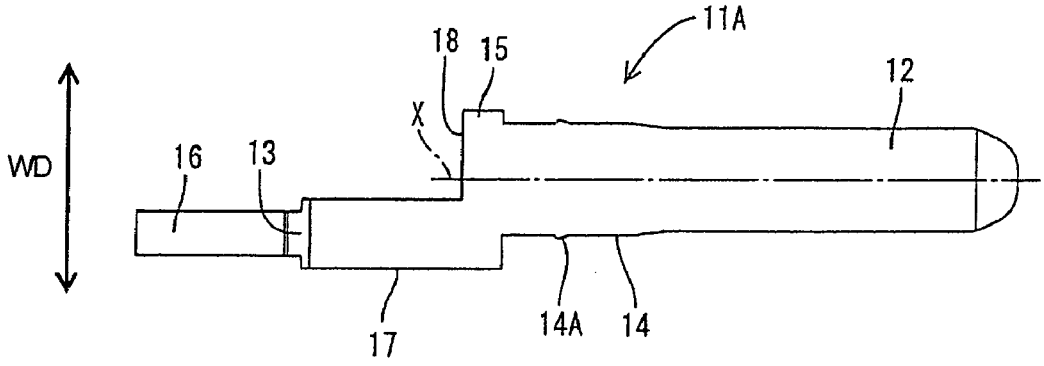
FIGS. 8(A) and 8(B) are plan views of the first and second terminal fittings.
Figure 8B:
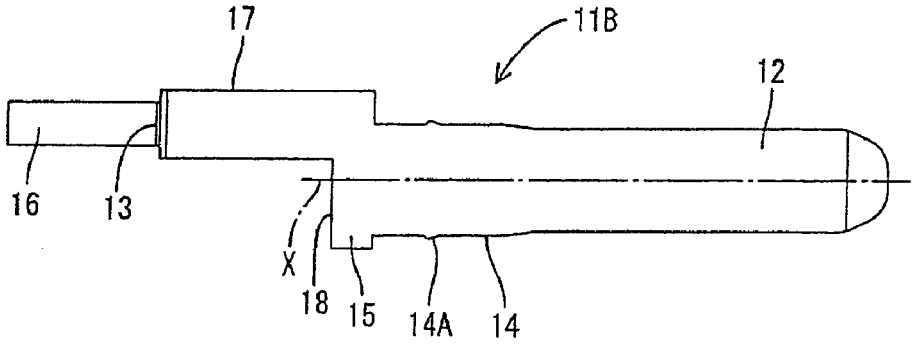

As shown in FIGS. 7 and 8, there are two kinds of terminal fittings 11, namely, longer first terminal fittings 11A and shorter second terminal fittings 11B. In the case of a description common to the first and second terminal fittings 11A, 11B, they are referred to as the terminal fittings 11.

Each terminal fitting 11 is formed by bending a narrow and long busbar into a substantially in L-shape. A terminal connecting portion 12 is formed at one end of the terminal fitting 11 and is configured for connection with a female terminal fitting (not shown) mounted in the mating housing. A board connecting portion 13 is formed at the end of the terminal fitting 11 opposite the terminal connecting portion 12 for connection with a conductor on the PCB 40 by soldering, press-fitting, clamping or the like. The first and second terminal fittings 11A, 11B are classified depending on the extension of the board connecting portions 13.

Figure 10:
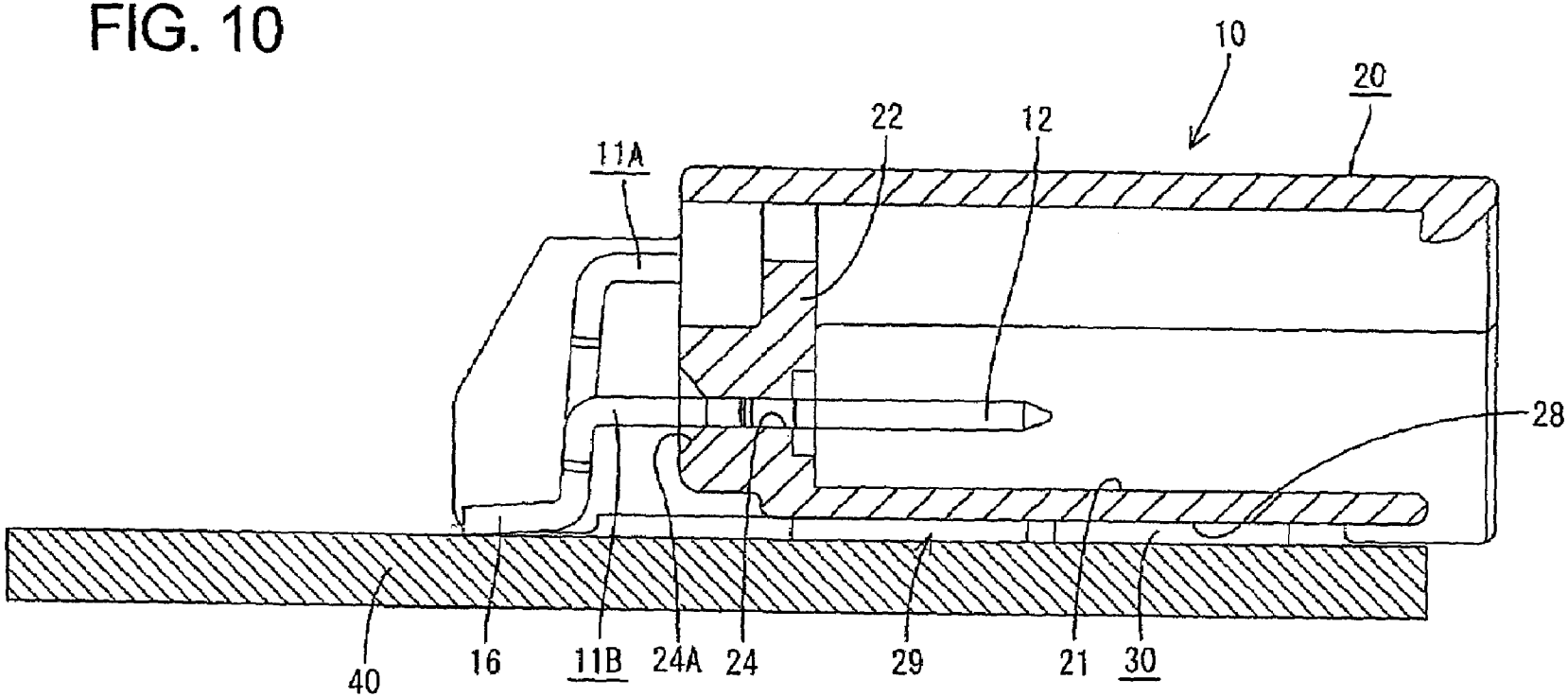
FIG. 10 is a longitudinal section showing a state where the connector is mounted on the PCB.

The terminal connecting portion 12 is a wide tab and is pressed into a press-in hole 24 of the housing 20 from behind. As shown in FIG. 10, an entrance 24A of each press-in hole 24 is widened and the upper and lower surfaces are slanted or rounded for guiding. The opposite side surfaces at the rear side of the terminal connecting portion 12 are extended slightly to form press-in portions 14 and biting projections 14A project at intermediate positions of the press-in portions 14. Stoppers bulge out from the opposite side surfaces at the rear end of the terminal connecting portion 12.

As shown in FIGS. 7 and 10, the board connecting portion 13 projects back a short distance from the rear end of the terminal connecting portion 12 and then is bent down to define an angle slightly larger than 90°. The terminal fitting 11 is mounted on the outer surface of the PCB 40, preferably by the reflow soldering. Thus, a mounting portion 16 is bent to define an angle slightly larger than 90° at the bottom end of the board connecting portion 13 to extend substantially backward.

The board connecting portion 13 is narrow and is smaller than about half the width of the terminal connecting portion 12.

As shown in FIG. 8, the board connecting portion 13 of the first terminal fitting 11A is at the rear end of the terminal connecting portion 12, and is offset in a first direction along the width direction WD (e.g. to right) from a longitudinal axis X of the terminal connecting portion 12 when viewed from behind. Furthermore, the board connecting portion 13 projects back from the rear end of the terminal connecting portion 12 and then is bent down.

The board connecting portion 13 of the second terminal fitting 11B is formed at the rear end of the terminal connecting portion 12, and is offset in a second direction along the widthwise direction WD opposite to the first direction from the longitudinal axis X of the terminal connecting portion 12, e.g. to left when viewed from behind. Furthermore, the board connecting portion 13 is bent down after projecting back from the rear of the terminal connecting portion 12.

Figure 9:
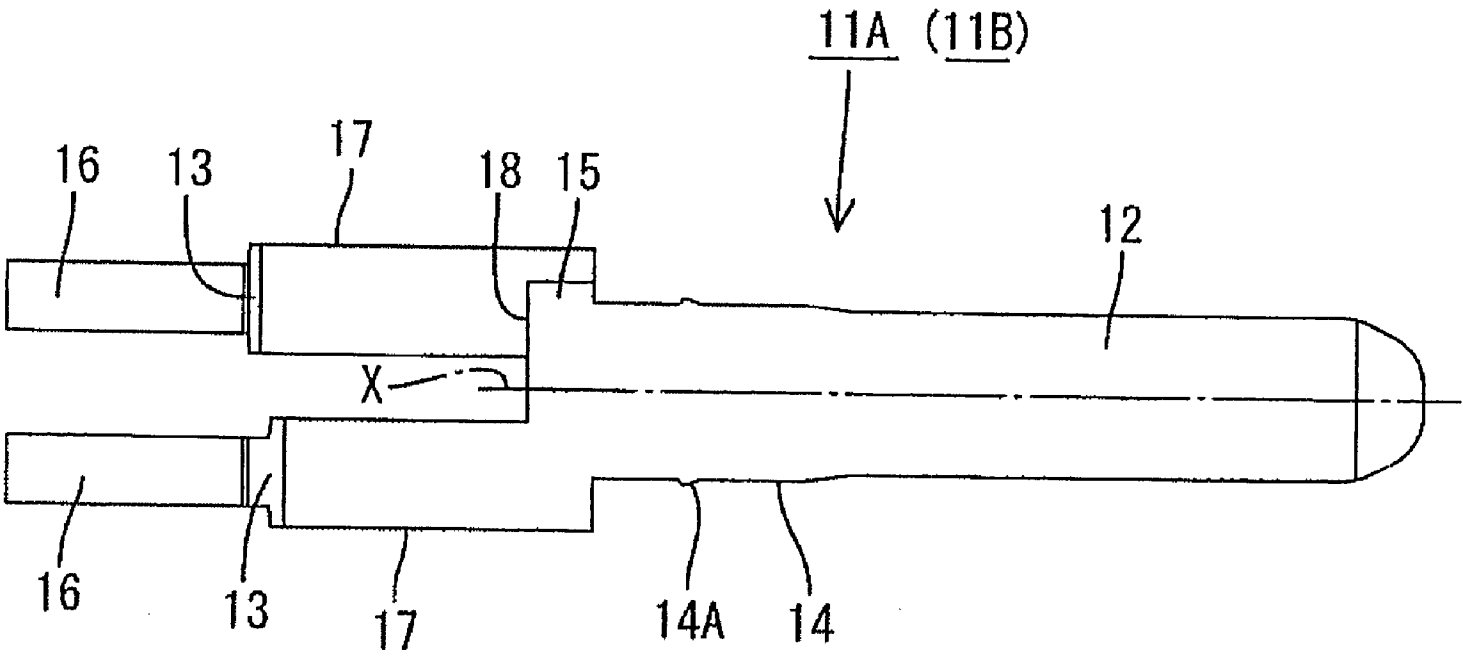
FIG. 9 is a plan view showing the first and second terminal fittings arranged one over the other.

The first and second terminal fittings 11A, 11B are arranged to substantially vertically align the terminal connecting portions 12, as shown in FIG. 9. Thus, the board connecting portions 13 of the respective terminal fittings 11A, 11B and the mounting portions 16 at the bottom ends of the board connecting portions 13 are distanced from each other at the opposite widthwise sides of the longitudinal axis X of the terminal connecting portion 12.

An interval between the mounting portions 16 of the two terminal fittings 11 is set to be exactly half the interval between the mounting portions 16 of the adjacent second terminal fittings 11B.

A bent reinforcement 17 is defined on part of the board connecting portion 13 of each terminal fitting 11A, 11B adjacent the rear end of the terminal connecting portion 12. The reinforcement 17 is slightly wider than the lower part of the terminal connecting portion 12 to increase bending rigidity. An outer surface of the reinforcement 17 is substantially flush with the bulging surfaces of the stoppers 15 and an inner surface is slightly offset towards the outer side from the longitudinal axis X of the terminal connecting portion 12. A tapered step is defined at the bottom end of the reinforcement 17 to alleviate stress.

Each terminal fitting 11A, 11B has a rearwardly facing pressing surface 18 at the rear end of the terminal connecting portion 12 and the stoppers 15. The pressing surface 18 is substantially normal to the longitudinal axis X of the terminal connecting portion 12 in an area larger than about half the width of the stoppers 15. The pressing surface 18 can be engaged a jig for pressing the terminal connecting portion 12 into the press-in hole 24.

Fixing members 30 are mountable at the opposite left and right surfaces of the housing 20 for fixing the housing 20 on the PCB 40 by soldering. Each fixing member 30 is formed unitarily by press-working a metal plate and includes a main plate 31 and a mounting plate 32 to one another. Solder entering holes 33 are formed at specified intervals substantially along longitudinal direction LD in the mounting plate 32 in the shown example.

A mounting groove 27 for the fixing member 30 is formed in each of the left and right side walls 26 of the housing 20. Rear parts of the side walls 26 project from the rear surface of the housing 20 to protect soldered portions of the terminal fittings 11. The fixing member 30 is mounted preferably so as not to come out by pressing the main plate 31 down into the mounting groove 27 from a side opposite the PCB 40 and positioning the mounting plate 32 slightly below the bottom surface of the housing 20, as shown in FIG. 4.

The bottom surface of the housing 20, excluding the side walls 26, has a recessed surface 28 to provide a flux escaping space 29 as shown in FIGS. 3 and 10.

A jig is urged against the pressing surface 18 at the right side area of the rear end of the terminal connecting portion 12 to insert the terminal connecting portion 12 of the second terminal fitting 11B into the press-in hole 24 at the lower stage. Thus, the press-in portions 14 are pressed into the press-in hole 24 and bite into the lateral walls of the press-in hole 24. The pushing operation is stopped when the stoppers 15 contact the back edges of the entrance 24A (see FIG. 6).

Similarly, a jig is used to urge the first terminal fittings 11A into the press-in hole 24 at the upper stage after all of the second terminal fittings 11B have been inserted.

Figure 6:
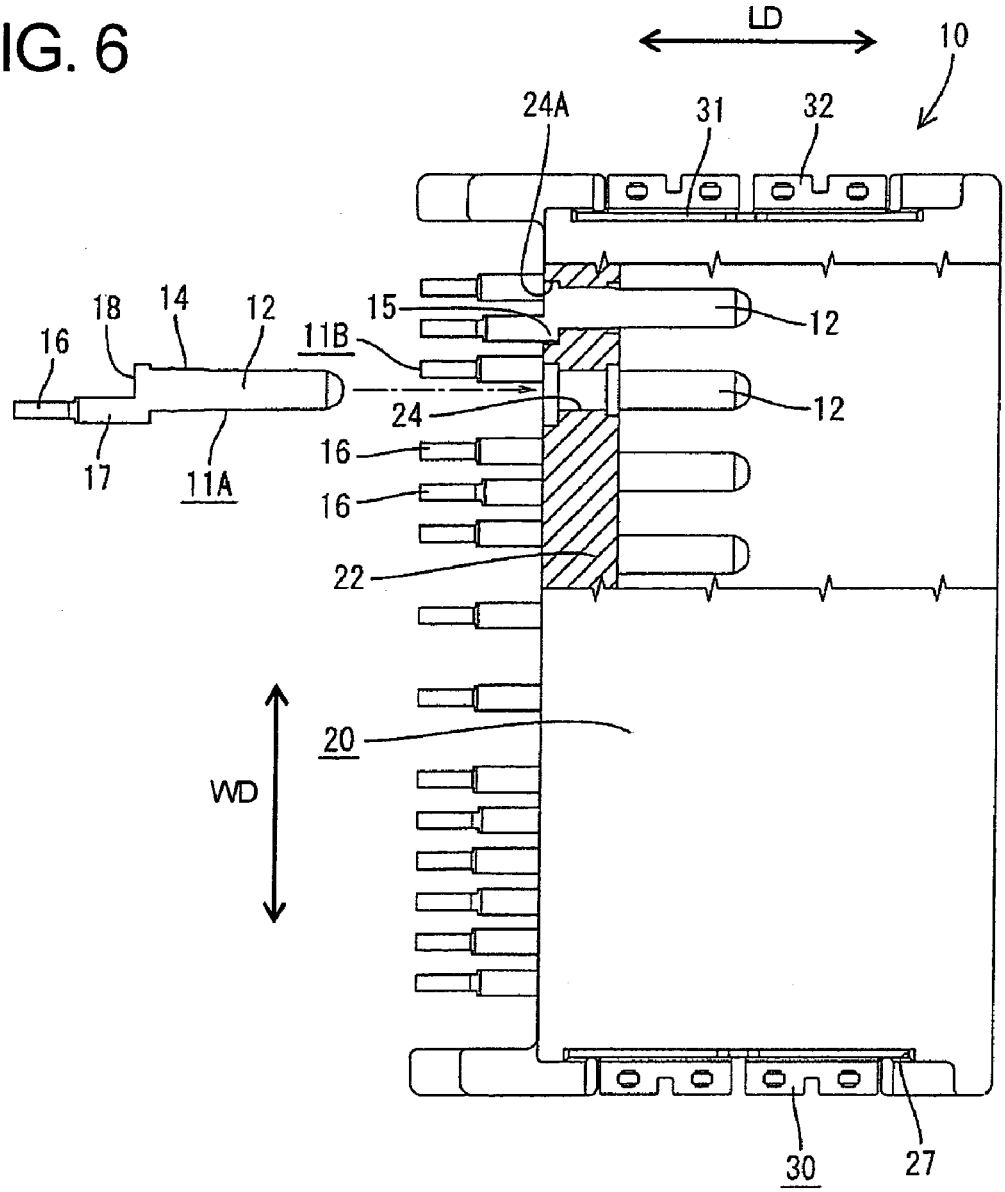
FIG. 6 is a plan view partly in section of the connector.

In this way, the terminal fittings 11A, 11B at the upper and lower stages project by substantially the same distance in the fitting recess 21 of the housing 20 as shown in FIG. 6. Simultaneously, the mounting portions 16 of the board connecting portions 13 of the terminal fittings 11A, 11B at the upper and lower stages are aligned transversely in a widthwise direction WD in a row at positions back from the housing 20 by a specified distance. Additionally, the mounting portions 16 of the first and second terminal fittings 11A, 11B are arranged alternately at specified intervals. It should be noted that the mounting portions 16 of the terminal fittings 11A, 11B are inclined slightly down towards their rear ends, as shown in FIG. 10.

The fixing members 30 are positioned and mounted into the mounting grooves 27 of the opposite side walls 26 of the housing 20.

Solder preferably is applied beforehand at parts of the outer surface of the PCB 40 where soldering is planned. Thereafter, the connector 10 is placed on the surface of the PCB 40 so that the mounting portions 16 of the board connecting portions 13 of the terminal fittings 11A, 11B and the mounting plates 32 of the fixing members 30 are at the solder applied positions.

The PCB 40 having the connector 10 placed thereon is conveyed to a high-temperature environment, such as in a high-temperature oven (not shown), in this state. Thus, the solder applied to the PCB beforehand becomes molten to attach to the mounting portions 16 of the terminal fittings 11A, 11B. The molten solder also attaches to the peripheral edges of the mounting plates 32 of the fixing members 30 and enters the solder entering holes 33 to attach to the inner surfaces of the holes 33.

The solder cools and solidifies so that the board connecting portions 13 of the terminal fittings 11A, 11B are secured and electrically connected to the corresponding conductor paths, and the mounting plates 32 are secured to the PCB 40. Accordingly, the housing 20 is mounted while being slightly lifted from the PCB 40.

The bent reinforcing portion 17 of the board connecting portion 13 of each terminal fitting 11 is formed wider to increase the bending rigidity. Thus, the board connecting portion 13 can be bent with high precision and the mounting portion 16 at the leading end is arranged in a proper posture to face the PCB 40. Thus, a wide area of the lower surface of the mounting portion 16 can be pressed against the solder applied to the PCB 40 beforehand, and the mounting portion 16 can be secured securely and strongly.

Flux preferably is applied over the solder to improve the wettability of the solder and/or to prevent oxidation in the reflow soldering. This flux similarly becomes molten when the solder is melted. The melted flux can flow down under the bottom surface of the housing 20, and could lift the housing 20 when being solidified. Thus, the flux may peel off the soldered portions of the terminal fittings 11 and may enter the fitting recess 21 between the male and female terminal fittings at the time of connection with the mating housing to cause an erroneous connection. Particularly, in the applied reflow soldering solder is applied to the electric/electronic device such as the circuit board 40 beforehand, the mounting portions 16 of the terminal fittings 11 are placed on the solder, and the solder is melted in a high-temperature environment to connect the mounting portions 16 with the circuit board 40. In other words, reflow soldering is a process that enables the soldering of components through a gradual and controlled heating of the components in a heated environment (such as in a furnace, typically a belt furnace or infrared, convection and/or vapor phase heating systems). A pasted form of solder powder and flux suspended in an organic vehicle preferably is arranged on at least part of the components to be connected and melted by the application of heat so that the components are joined through the mass heating of the preplaced solder paste in order to solder fillets in the metallized surfaces thereof. The flux facilitates the production of the solder joint, and may be used to remove oxides from the respective conductive surfaces to be joined and to enable better wetting or wettability or reduce the surface-tension of the portions to be soldered. Flux is usually a liquid or solid material frequently based on natural/synthetic rosin as a main component.

However, in this embodiment, the housing 20 is mounted while being slightly lifted from the PCB 40 and the recessed surface 28 preferably is formed in at least part of the bottom surface of the housing 20 to provide a wide flux escaping space 29 between the recessed surface 28 and the outer surface of the PCB 40. Therefore, even if the flux should flow down, it is accommodated in the escaping space 29 and does not cause the aforementioned problems.

As described above, the board connecting portions 13 of the respective terminal fittings 11A, 11B are offset towards the opposite widthwise sides with respect to the longitudinal axes X of their terminal connecting portions 12. Thus, the board connecting portions 13 of the terminal fittings 11A, 11B at the upper and lower stages can be arrayed transversely in one row at positions spaced back from the housing 20 by substantially the same distance. Additionally, the mounted board connecting portions 13 are offset along the width direction WD of the terminal fittings 11 while the terminal connecting portions 12 of the fitting terminals 11A, 11B are aligned vertically.

As a result, the width of the housing 20 can be shortened and, simultaneously, the backward projecting distance of the terminal fittings 11 from the housing 20 can be shortened. Therefore, a mounting space can be made smaller and the material cost and the production cost of the housing 20 can be reduced.

Further, the pressing surface 18 is substantially normal to the pressing direction and takes advantage of the area of the rear end surface of each terminal connecting portion 12 not coupled to the board connecting portion 13. Thus, the operation of mounting the terminal fitting 11 by pressing it can be smoothly and efficiently performed.

The board connecting portions 13 are narrower than the terminal connecting portions 12. Thus, the bending precision of the board connecting portions 13 could be reduced. However, the board connecting portions 13 have wider and/or thicker reinforcements 17 to increase the bending rigidity and to achieve highly precise bends. Thus, the mounting portions 16 can be arranged in proper postures to face the PCB 40, and reflow soldering can be performed precisely to achieve strong attachments to the PCB 40.

Figure 11:
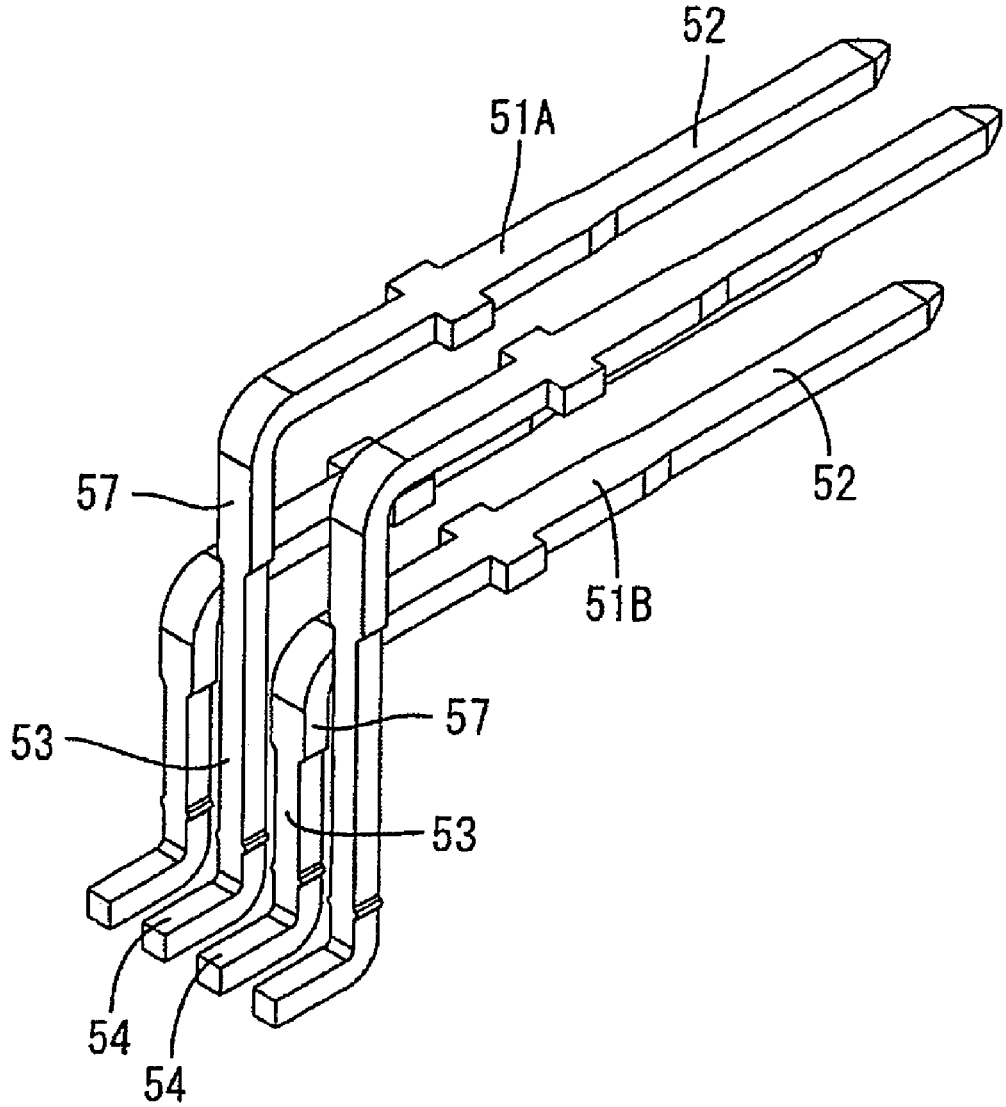
FIG. 11 is a perspective view of terminal fittings according to a second embodiment of the invention.
Figure 12:
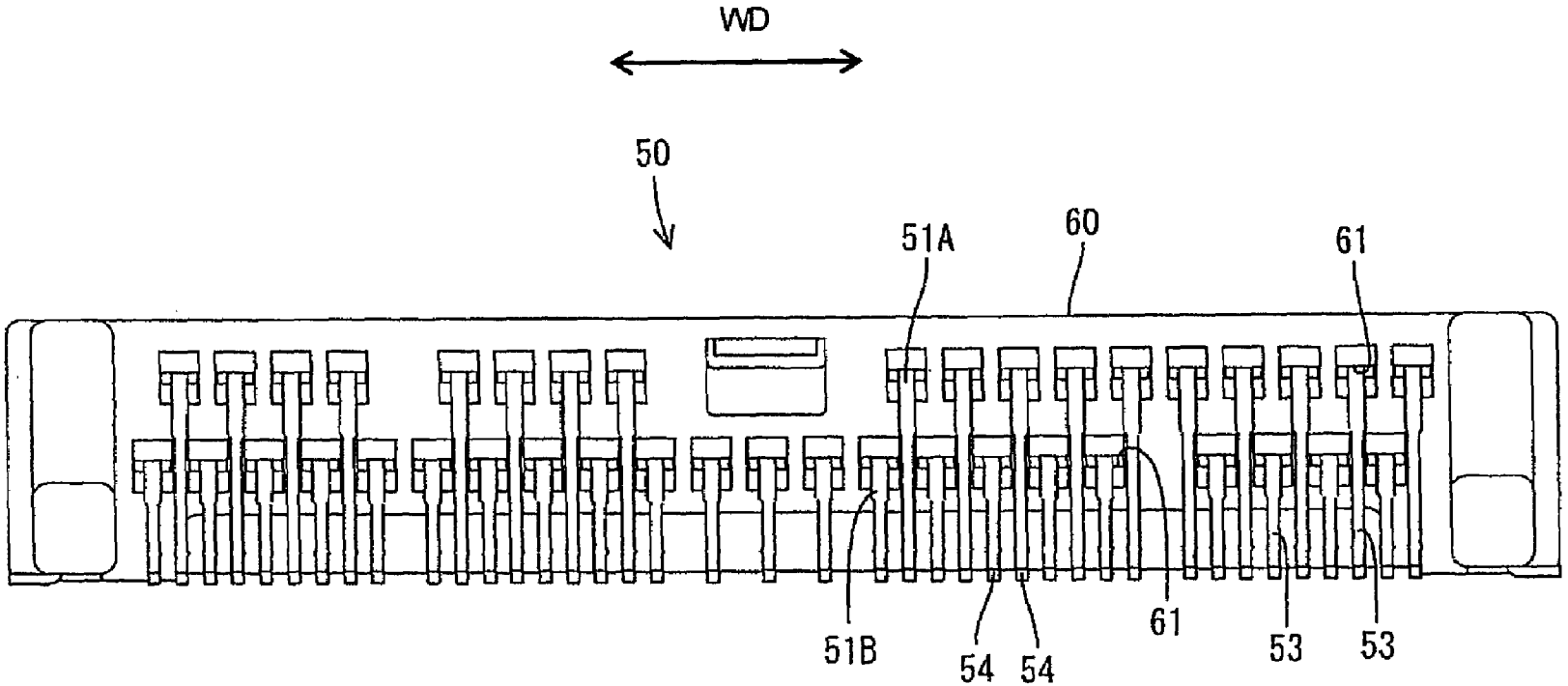
FIG. 12 is a rear view of a connector according to the second embodiment.

FIGS. 11 and 12 show a circuit board connector 50 according to a second embodiment. The connector 50 has terminal fittings 51A, 51B formed from long narrow busbars that define substantially rectangular columns. The busbars are bent into substantially L-shapes. A terminal connecting portion 52 is defined at one end and can be pressed into a press-in hole 61 of a housing 60. A board connecting portion 53 is at the other end and is bent further to define a mounting portion 54.

The terminal fittings 51 may have a poor bending rigidity due to the narrow material. However, bent portions thereof are widened and/or thickened to form reinforcements 57. As a result, the board connecting portions 53 can be bent precisely and the mounting portions 54 can be arranged in proper postures to face the PCB 40. Thus, precise reflow soldering can be expected, and the board connecting portions 53 can be fixed securely and strongly.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The board connecting portions of the terminal fittings at the upper and lower stages can be offset in opposite widthwise directions WD.

The invention is also applicable to connectors in which terminal fittings are mounted at one, three or more stages. In the case of connectors in which terminal fittings are mounted at three or more stages, board connecting portions of the terminal fittings at the respective terminal fittings are arranged in different areas defined by dividing the terminal fittings along width direction WD preferably by the same number as the number of the stages.

The terminal fittings are not limited to those mounted later by being pressed into the press-in holes as illustrated in the above embodiments, and may be integrally mounted by insert molding.

As a means for connecting the terminal fittings with the PCB, flow soldering may be employed according to which the leading ends of the board connecting portions are inserted into through holes formed in the PCB and let to float in a molten solder bath to be solder-connected.

What is claimed is:

1. A connector for an electric or electronic device, comprising:

a housing for mounting on the device, the housing having a base wall with opposite front and rear ends, first and second arrays of press-in holes extending through the base wall from the front end to the rear end, the first array being substantially parallel to the second array at the front and rear ends of the base wall, front ends of the press-in holes of the first array being aligned respectively with front ends of the press-in holes of the second array in directions normal to the planes defined by the first and second arrays of the press-in holes, rear ends of the press-in holes of the first array being offset respectively from rear ends of the press-in holes of the second array in directions normal to the planes defined by the first and second arrays; and a plurality of terminal fittings mountable substantially side by side along a width direction at first and second stages in the housing corresponding to the first and second arrays of press-in holes, each terminal fitting having opposite front and rear ends, a terminal connecting portion substantially at the front end of the terminal fitting and projecting forward of the base wall for connection with a mating terminal, and a device connecting portion substantially at the rear end of the terminal fitting, the device connecting portion being bent substantially toward the device at a location rearward of the housing, the device connecting portions being narrower than the terminal connecting portions, the terminal connecting portion of each of said terminal fittings being substantially aligned along a height direction with the terminal connecting portion of at least one of said terminal fittings in another of the stages to define a substantially vertical array, the device connecting portions of the terminal fittings in each of said vertical arrays being offset alone the width direction, wherein adjacent terminal fittings in each of the vertical arrays having their device connecting portions offset to opposite widthwise sides with respect to longitudinal axes of the terminal connecting portions, a mounting portion defined on the device connecting portion and disposed at the rear end of each of the terminal fittings, the device connecting portions lying substantially in a common plane and being substantially equally spaced from one another at substantially equal distances from the base wall of the housing.

2. The connector of claim 1, wherein the terminal connecting portions of the terminal fittings are press-fit into press-in holes in the housing, and pressing surfaces are defined between the terminal connecting portions and the device connecting portions for pressing the terminal connecting portions.

3. The connector of claim 2, wherein the pressing surfaces are substantially normal to a pressing direction and are at a rear end of each respective terminal connecting portion.

4. A connector for an electric or electronic device, comprising:

a housing for mounting on the device, the housing having a base wall with opposite front and rear ends, first and second arrays of press-in holes extending through the base wall from the front end to the rear end, the first array being substantially parallel to the second array at the front and rear ends of the base wall, front ends of the press-in holes of the first array being aligned respectively with front ends of the press-in holes of the second array in directions normal to the planes defined by the first and second arrays of the press-in holes, rear ends of the press-in holes of the first array being offset respectively from rear ends of the press-in holes of the second array in directions normal to the planes defined by the first and second arrays;

first and second arrays of terminal fittings mounted respectively in the first and second arrays of press-in holes of the housing, the terminal fittings each having opposite front and rear ends, a terminal connecting portion adjacent the front end of each of the terminal fittings and extending forward through the press-in holes of the housing for connection with a mating terminal, the terminal connecting portions in the first array of terminal fittings lying in a first plane and the terminal connecting portions of the second array of terminal fittings lying in a second plane that is parallel to the first plane, each terminal connecting portion of the first array being aligned with a terminal connecting portion of the second array in a direction normal to the planes, each terminal fitting having a device connecting portion disposed rearward of the housing, the device connecting portions in the first array of terminal fittings being offset in a first direction relative to the terminal connecting portions of the first array of terminal fittings, the device connecting portions in the second array of terminal fittings being offset in a second transverse direction from the terminal connecting portions in the second array of terminal fittings, a mounting portion defined on the device connecting portion and disposed at the rear end of the terminal fitting, the device connecting portions of the terminal fittings in the first and second arrays being disposed in a single plane and substantially equally spaced from one another, and a substantially L-shaped bend between the terminal connecting portion and the device connecting portion for bending the mounting portion towards the device, portions of each respective terminal fitting at the bend being cross-sectionally larger than the device connecting portion for increasing bending rigidity through the bend, whereby the increased bending rigidity enables an accurate bend, and whereby the mounting portion can be fixed to the device by the reflow soldering.

5. The connector of claim 4, wherein the housing is configured to be mounted so that portions of the housing are spaced slightly from the device to provide a flux escaping space opposed to the device.

* * * * *